US010385494B2

(12) United States Patent
Sim et al.

(10) Patent No.: US 10,385,494 B2
(45) Date of Patent: Aug. 20, 2019

(54) LAUNDRY TREATING APPARATUS WITH DRAWER UNLOCKING UNIT

(71) Applicant: LG ELECTRONICS INC., Seoul (KR)

(72) Inventors: Inbo Sim, Seoul (KR); Jinwoo Seo, Seoul (KR); Jihong Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 164 days.

(21) Appl. No.: 15/252,390

(22) Filed: Aug. 31, 2016

(65) Prior Publication Data

US 2017/0067197 A1 Mar. 9, 2017

(30) Foreign Application Priority Data

Sep. 4, 2015 (KR) ..... 10-2015-0125700

(51) Int. Cl.
*D06F 29/00* (2006.01)
*D06F 31/00* (2006.01)
(Continued)

(52) U.S. Cl.
CPC ..... *D06F 29/00* (2013.01); *A47B 88/41* (2017.01); *A47B 95/02* (2013.01); *D06F 21/06* (2013.01);
(Continued)

(58) Field of Classification Search
CPC ..... D06F 37/10; D06F 37/18; D06F 37/25; D06F 39/14; D06F 31/00; D06F 29/00;
(Continued)

(56) References Cited

U.S. PATENT DOCUMENTS 4,838,624 A 6/1989 Walla
8,234,889 B2 * 8/2012 Kim ..... D06F 25/00 68/140
(Continued)

FOREIGN PATENT DOCUMENTS

CN 101407990 A 4/2009
CN 101451295 A 6/2009
(Continued)

OTHER PUBLICATIONS

Machine translation of DE 8515172 U1 to Schaefer, Aug. 1985 (Year: 1985).*
(Continued)

*Primary Examiner* — Joseph L. Perrin
(74) *Attorney, Agent, or Firm* — Fish & Richardson P.C.

(57) ABSTRACT

A laundry treating apparatus includes a drawer. The laundry treating apparatus further includes a cabinet that is configured to receive the drawer. The laundry treating apparatus further includes a drum that is configured to rotate and that is located inside the drawer. The laundry treating apparatus further includes fastening units that are configured to dampen one of vertical motion or horizontal motion of the drawer and that are configured to connect the drawer to the cabinet. The laundry treating apparatus further includes a feeding unit that is configured to operate the fastening units. The laundry treating apparatus further includes a driving unit that is configured to reciprocate the feeding unit along another one of the horizontal direction or the vertical direction. The laundry treating apparatus further includes an unlocking unit that is configured to restrict movement of the feeding unit to one direction.

13 Claims, 7 Drawing Sheets

(51) Int. Cl.

| | |
|---|---|
| ***D06F 37/28*** | (2006.01) |
| ***D06F 39/14*** | (2006.01) |
| ***D06F 37/18*** | (2006.01) |
| ***D06F 23/04*** | (2006.01) |
| ***A47B 95/02*** | (2006.01) |
| ***D06F 21/06*** | (2006.01) |
| ***D06F 58/04*** | (2006.01) |
| ***A47B 88/41*** | (2017.01) |
| *D06F 37/42* | (2006.01) |

(52) U.S. Cl.
CPC ..... *D06F 23/04* (2013.01); *D06F 31/00* (2013.01); *D06F 37/18* (2013.01); *D06F 37/28* (2013.01); *D06F 39/14* (2013.01); *D06F 58/04* (2013.01); *A47B 2095/024* (2013.01); *A47B 2210/0091* (2013.01); *A47B 2210/17* (2013.01); *D06F 37/42* (2013.01)

(58) Field of Classification Search
CPC ... E05C 1/00; E05C 1/16; E05C 9/045; E05B 65/44; E05B 65/46
See application file for complete search history.

(56) References Cited

U.S. PATENT DOCUMENTS

| | | | | |
|---|---|---|---|---|
| 2002/0056293 | A1 | 5/2002 | Kin et al. | |
| 2004/0017088 | A1* | 1/2004 | Sawatani | E05B 83/30 292/178 |
| 2004/0093913 | A1* | 5/2004 | Bolduan | D06F 39/02 68/17 R |
| 2006/0012190 | A1* | 1/2006 | Alacqua | A47L 15/4259 292/341.16 |
| 2008/0092606 | A1* | 4/2008 | Meekma | E05B 63/0056 70/120 |
| 2009/0113945 | A1* | 5/2009 | Kim | D06F 17/04 68/5 C |
| 2009/0139275 | A1 | 6/2009 | Kim et al. | |
| 2009/0145175 | A1 | 6/2009 | Kim et al. | |
| 2010/0064736 | A1 | 3/2010 | Jeong et al. | |
| 2011/0265524 | A1 | 11/2011 | Kim et al. | |
| 2014/0196507 | A1 | 7/2014 | Lee et al. | |
| 2014/0210219 | A1* | 7/2014 | Pipp | F03G 7/065 292/144 |
| 2014/0225379 | A1* | 8/2014 | Fukumoto | E05B 83/30 292/40 |

FOREIGN PATENT DOCUMENTS

| | | |
|---|---|---|
| CN | 101974838 | 2/2011 |
| CN | 102844486 A | 12/2012 |
| CN | 104250906 | 12/2014 |
| DE | 8515172 | 10/1985 |
| DE | 10109533 | 9/2002 |
| DE | 112011101522 | 5/2013 |
| EP | 2543760 | 1/2013 |
| EP | 3064637 | 9/2016 |
| JP | 2002285746 A | 10/2002 |

OTHER PUBLICATIONS

International Search Report and Written Opinion in International Application No. PCT/KR2016/009734, dated Nov. 16, 2016, 10 pages.
Extended European Search Report issued in European Application No. 16186982.1 dated Dec. 5, 2016, 10 pages.
Australian Office Action in Australian Application No. 2016317800, dated Jul. 6, 2018, 2 pages.

* cited by examiner

Fig 3(a)
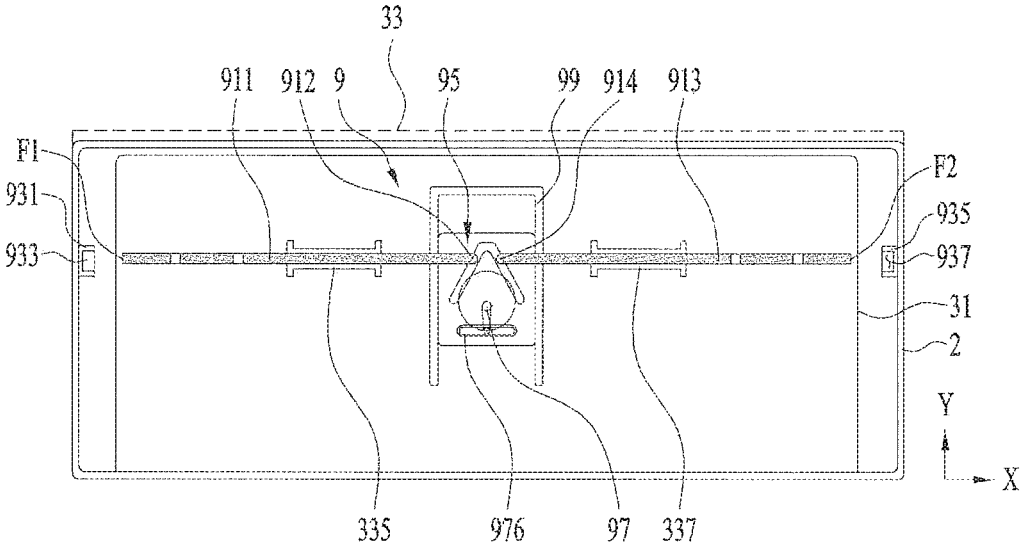
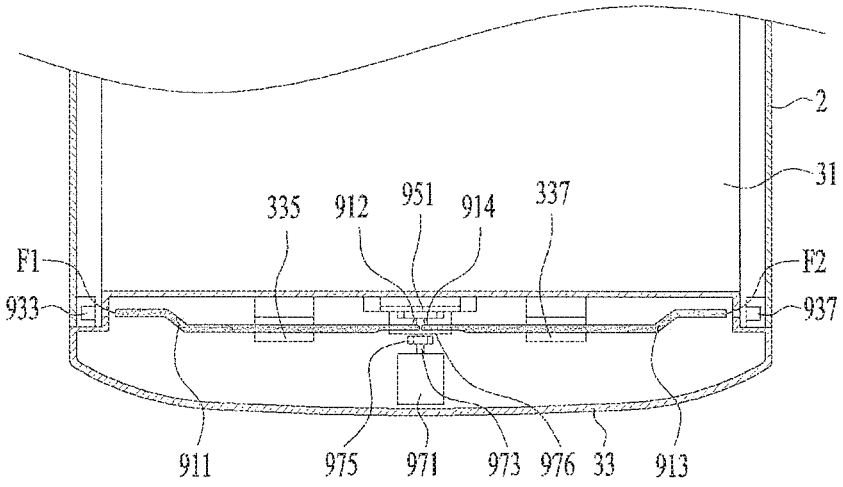
Fig 3(b)

Fig 5(a)
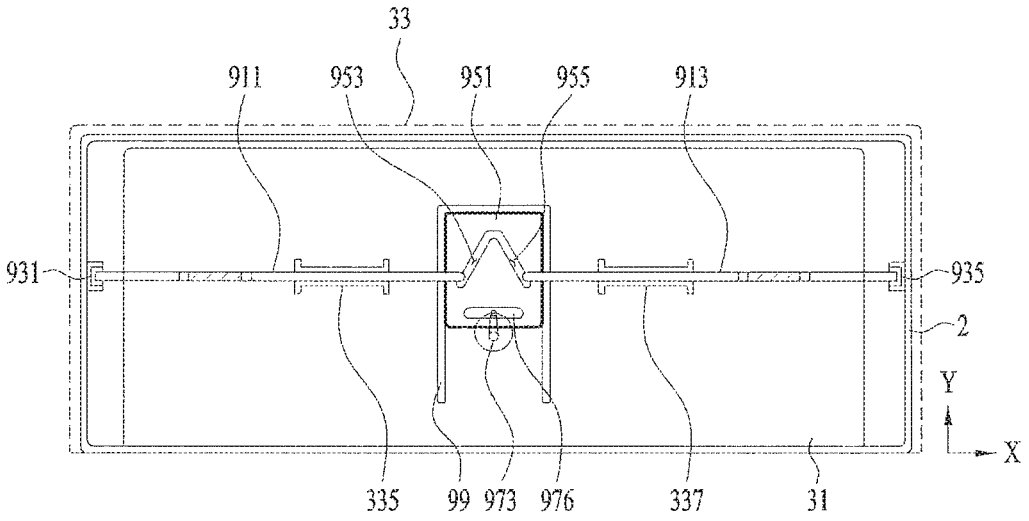
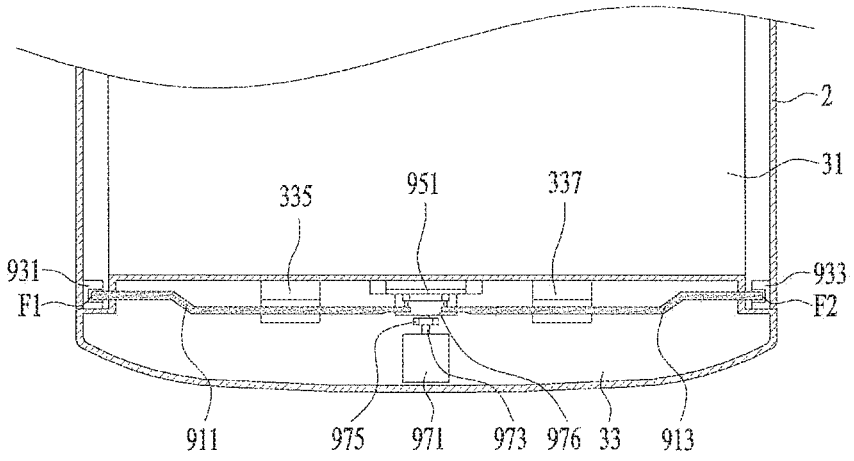
Fig 5(b)

LAUNDRY TREATING APPARATUS WITH DRAWER UNLOCKING UNIT

This application claims the benefit of the Korean Patent Application No. 10-2015-0125700, filed on Sep. 4, 2015, which is hereby incorporated by reference as if fully set forth herein.

FIELD

The present disclosure relates to a laundry treating apparatus.

BACKGROUND

Generally, a laundry treating apparatus includes an apparatus for washing laundry (laundry for washing or laundry for drying), an apparatus for drying laundry, and an apparatus for performing both washing and drying laundry.

A laundry treating apparatus of the related art includes a cabinet, a drawer provided to be ejected from the cabinet, and a receiving portion provided inside the drawer, providing a treating space of laundry such as washing or drying of laundry.

SUMMARY

According to an innovative aspect of the subject matter described in this application, a laundry treating apparatus includes a drawer; a cabinet that is configured to receive the drawer; a drum that is configured to rotate, that is located inside the drawer, and that is configured to receive laundry; fastening units that are configured to dampen one of vertical motion or horizontal motion of the drawer and that are configured to connect the drawer to the cabinet; a feeding unit that is configured to operate the fastening units; a driving unit that is configured to reciprocate the feeding unit along another one of the horizontal direction or the vertical direction; and an unlocking unit that is configured to restrict movement of the feeding unit to one direction and that is configured to unlock the drawer from the cabinet.

This and other implementations may include one or more of the following optional features. The fastening units include a first bar reciprocating along the width direction of the drawer by means of the feeding unit, that includes a first coupling unit that is connected to the feeding unit, and that includes a first bar free end that is configured to engage the cabinet; and a second bar reciprocating along the width direction of the drawer by means of the feeding unit, that includes a second coupling unit that is connected to the feeding unit, and that includes a second bar free end that is configured to engage the cabinet. The feeding unit includes a feeding body that is configured to reciprocate along the vertical direction. The feeding body defines a first slot that is configured to receive the first coupling unit, that is configured to connect the first bar free end to the cabinet based on the feeding body moving in a first direction, and that is configured to detach the first bar free end from the cabinet based on the feeding body moving in a second direction. The feeding body defines a second slot that is configured to receive the second coupling unit, that is configured to connect the second bar free end to the cabinet based on the feeding body moving in the first direction, and that is configured to detach the second bar free end from the cabinet based on the feeding body moving in the second direction.

The laundry treating apparatus further includes a guider that is configured to guide the feeding body in the first direction and in the second direction and that is configured to restrict horizontal movement of the feeding body. The unlocking unit includes a handle that is located on the drawer and that is configured to detach from the drawer; and a wire that is configured to connect the feeding body with the handle and that is configured to move the feeding body in the second direction only. The first slot and the second slot are symmetrical about a reference line that is parallel with a direction that the feeding body is configured to move. The first slot and the second slot each define an angle with respect to the reference line that is between zero degrees and ninety degrees. A distance between the first coupling unit and the second coupling unit increases based on the feeding body moving in the first direction. The distance between the first coupling unit and the second coupling unit decreases based on the feeding body moving in the second direction. The driving unit includes an arm that rotates about a rotational axis and that includes a slot connecting unit; a motor that is configured to rotate the arm and that is configured to rotate the slot connecting unit in a circle with a diameter; and a body slot that is defined by the feeding unit, that is configured to receive the slot connecting unit, that has a length that is equal to or longer than the diameter and that is perpendicular to a direction along which the feeding body is configured to reciprocate. The length of the body slot is equal to the diameter. The length of the body slot is longer than the diameter.

The laundry treating apparatus further includes a controller that is configured to maintain a rotational angle that is defined by the arm and the direction along which the feeding body is configured to reciprocate between zero degrees and one-hundred eighty degrees based on the fastening units being engaged with the cabinet. The drawer further includes a handle support unit that is configured to connect the handle to the drawer. The handle includes a handle body that is connected to an end of the wire, wherein the handle support unit is configured to receive the handle body; and an ejecting unit that is configured to eject the handle body from the handle support unit. The ejecting unit includes a plate that extends from the handle body, a protrusion that protrudes from the plate, and a pressurizing request unit that is located between the protrusion and an end of the plate that is opposite the plate. The handle body is round and defines a hole in a middle of the handle body. The handle body is configured to rotate about the protrusion and eject front the handle support unit based on pressure being applied to the pressurizing request unit. The handle support unit is located on a bottom of the drawer, and the drawer defines a panel through hole that is configured to receive the wire and that is located at the handle support unit. The drawer further includes a wheel that is located on the bottom of the drawer, that is configured to support the drawer during movement of the drawer in and out of the cabinet, and that extends from the bottom of the drawer a distance that is less than a distance that the handle support unit extends from the bottom of the drawer. The wheel is located at a front of the drawer and is located closer to one side of the drawer than to another side of the drawer.

An object of the present subject matter described in this application is to provide a laundry treating apparatus that performs washing or drying of laundry through a receiving portion which may be ejected from a cabinet.

Another object of the subject matter described in this application is to provide a laundry treating apparatus that may prevent a receiving portion from being ejected from a cabinet while washing or drying of laundry is being performed.

BRIEF DESCRIPTION OF THE DRAWINGS

FIGS. 3(*a*) and 3(*b*) illustrate states in which example drawers may be ejected from cabinets.

FIGS. 5(*a*) and 5(*b*) illustrate states in which example drawers are fixed to cabinets.

DETAILED DESCRIPTION

Figure 1:
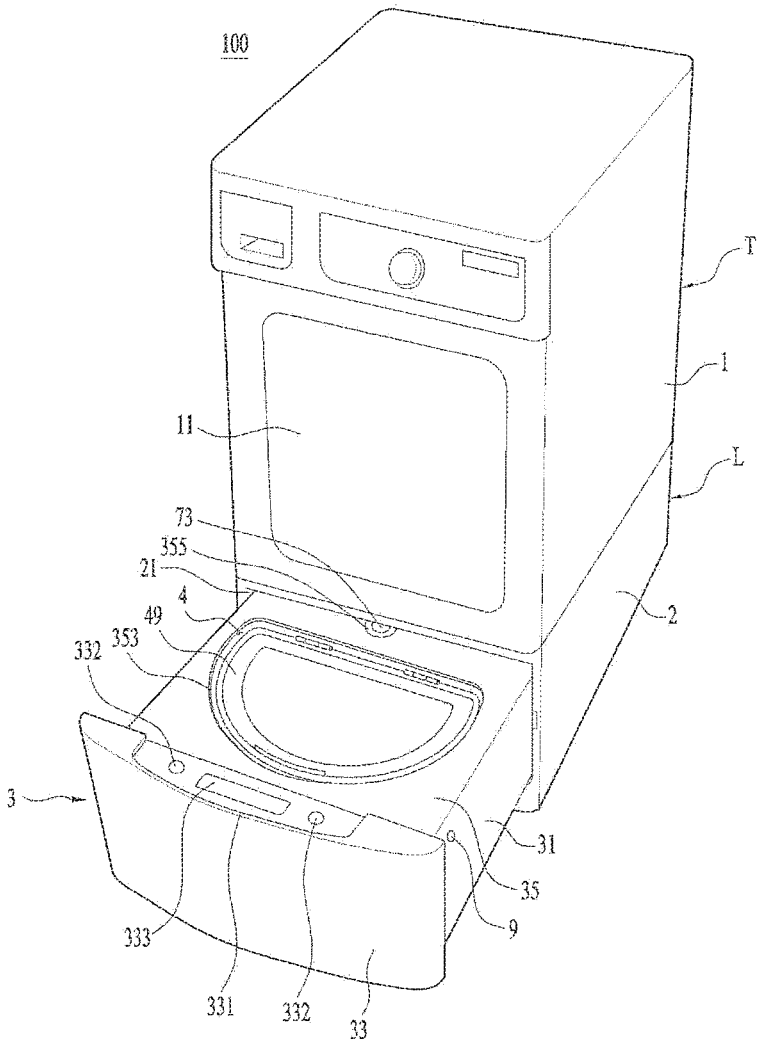
FIG. 1 is a perspective view of an example laundry treating apparatus.

A laundry treating apparatus 100 may include a first treating apparatus L only, or may include a first treating apparatus L and a second treating apparatus T as shown in FIG. 1. Hereinafter, for convenience of description, the laundry treating apparatus, which includes both a first treating apparatus L and a second treating apparatus T, will be described.

The first treating apparatus L is an apparatus for a laundry treating function such as washing or drying of laundry (wasting target or drying target), and the second treating apparatus T may detachably be provided in the first treating apparatus L to perform a laundry treating function.

Figure 2:
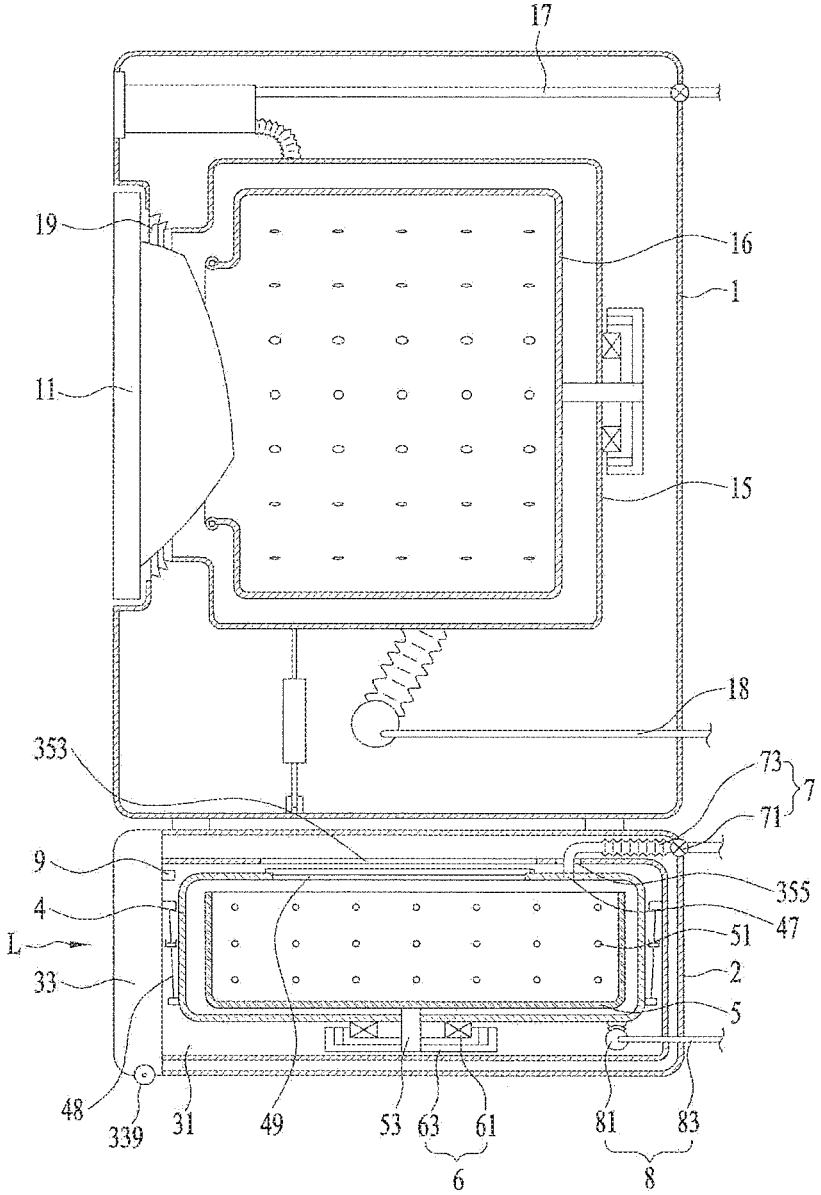
FIG. 2 is a cross sectional view of an example laundry treating apparatus.

As shown in FIG. 2, the second treating apparatus T may include a second cabinet 1 that defines an external appearance, and a second tub 15 provided inside the second cabinet 1. The second tub 15 stores washing water therein. The second treating apparatus T also includes a second drum 16 rotatably provided inside the second tub 15. The second drum 16 provides a space where laundry is stored. The second treating apparatus T further includes a second water supply unit 17 that supplies washing water to the second tub 15, and a second drainage unit 18 that discharges the washing water stored in the second tub 2 to the outside of the second cabinet 1.

The second cabinet 1 may include a second treating apparatus inlet 19 for inserting or ejecting laundry, wherein the second treating apparatus inlet 19 is opened or closed by a second treating apparatus door 11 rotatably coupled to the second cabinet 1.

The second treating apparatus inlet 19 communicates with the inside of the second drum 16 through a second tub inlet provided in the second tub 15 and a second drum inlet provided in the second drum 16. Therefore, a user may insert laundry into the second drum 16 by opening the door 11 or eject laundry stored in the second drum 16 to the outside of the second cabinet.

In some implementations, if the second treating apparatus T is provided to perform a drying function of laundry, a second hot-air supply unit supplying the heated air to the second tub should further be provided inside the second cabinet 1.

The second hot-air supply unit may include a circulation duct provided to circulate the air inside the second tub, and a heat exchanger provided inside the circulation duct to dehumidify and heat the air discharged from the second tub.

However, the second hot-air supply unit may include a discharge duct discharging the air inside the second tub to the outside of the second cabinet 1, a supply duct supplying the air outside the second cabinet 1 to the second tub 15, and a heat exchanger provided in the supply duct, heating the air flown to the supply duct.

If the second treating apparatus T is provided to perform only a drying function of laundry unlike the aforementioned description, the second tub 15 may be omitted from the second treating apparatus T. In this case, a means for rotatably supporting the drum should be provided inside the second treating apparatus T, and the aforementioned hot-air supply unit should be provided to supply the hot air to the second drum 16.

As shown in FIG. 1, the first treating apparatus L provided includes a cabinet 2, a drawer 3 provided to be ejected from the cabinet 2, and receiving portions 4 and 5 provided inside the drawer, providing laundry treating spaces.

The cabinet 2 forms external appearance of the first treating apparatus L, and the cabinet 2 may be arranged above or below the second treating apparatus T.

As shown in FIG. 1, if the first treating apparatus L is arranged below the second treating apparatus T, a position of the second treating apparatus door 11 gets higher by means of the first treating apparatus L, whereby a user may conveniently insert or eject laundry into or from the second treating apparatus T.

Also, vibration generated by the first treating apparatus L due to load of the second treating apparatus T may be attenuated, and a problem that the second treating apparatus is inclined toward an ejecting direction of the drawer 3 when the drawer 3 is ejected may be solved.

The cabinet 2 is provided with an opened surface 21, and the drawer 3 may be ejected from or inserted into the cabinet 2 through the opened surface 21. In this case, the opened surface 21 may be provided in a direction of the second treating apparatus door 11 (front surface of the second treating apparatus).

The drawer 3 includes a drawer body 31 of which upper surface is opened, and a drawer cover 35 provided in an opened surface of the drawer body 31. That is, the drawer body 31 may be provided in a hexahedral shape forming an empty space, and the drawer cover 35 may be provided to form the upper surface of the drawer body 31.

A drawer panel 33 is provided on a front surface of the drawer body 31. The drawer panel 33 is a means for opening or closing the front surface 21 of the cabinet and at the same time a means for ejecting or inserting the drawer body 31 from or into the cabinet 2. The drawer panel 33 is detachably coupled to the drawer body 31.

The drawer panel 33 may be provided with a control panel 331 for controlling an operation of the first treating apparatus L. The control panel 331 is a means for allowing a user to input a control command to control means (water supply unit, drainage unit) for supplying and draining washing water in the receiving portions 4 and 5, a means (drum driver) for rotating laundry and means (water supply unit, hot-air supply unit) for supplying steam or hot-air to laundry.

Also, the control panel 331 may be provided with an input unit 332 for allowing a user to input a control command to the first treating apparatus L. The control panel 331 also may include a display unit 333 (e.g., a display for displaying operation information of the first treating apparatus). The display unit 333 may notify a user of acknowledgement of the control command input through the input unit 332 or a process of implementing the control command input by the user.

The drawer panel 33 may further be provided with a wheel 339 (see FIG. 2). The wheel 339 may rotatably be provided on the bottom of the drawer panel 33. Therefore, the wheel 339 becomes a means for preventing the drawer panel 33 from being in contact with a ground when the drawer 3 is ejected from or inserted into the cabinet 2.

The drawer cover 35 is provided with a first through hole 353, which is provided to pass through the drawer cover 35. The first through hole 353 enables communication between inside of the drawer body 31 and outside of the drawer body 31. The drawer cover 35 also is provided with a second through bole 355, which is provided to pass through the drawer cover 35 and into which a water supply pipe 73 is inserted.

As shown in FIG. 2, the receiving portions 4 and 5 provided inside the drawer 3 may include a tub 4 provided inside the drawer body 31, providing a space where washing water is stored, and a drum 5 rotatably provided inside the tub 4, storing laundry therein.

The tub 4 is fixed into the drawer 3 by a tub support unit 48. The tub support unit 48 is a means for connecting a circumferential surface of the tub 4 with the drawer 3, and may be provided with a means for attenuation of vibration.

On an upper surface of the tub 4, an inlet 46 communicating the inside of the tub 4 with the outside of the tub 4, a door 49 opening or closing the inlet 46, and a water supply unit 47 supplying washing water to the tub 2 are provided.

The door 49 is rotatably provided on the upper surface of the tub 4 (to open or close a part of the tipper surface of the tub), and may be rotated without interfering with the drawer cover 35 through the first through hole 353. Therefore, a user may insert laundry into the tub 4 by opening the door 49 after ejecting the drawer 3 from the cabinet 2.

The drum 5 may be provided in a cylindrical shape of which upper surface is opened, and may be rotated inside the tub 4 by means of a drum driver 6 provided outside the tub 4.

The drum driver 6 may include a stator 61 fixed to the tub 4, forming a rotating magnetic field, and a rotor 63 rotated by the rotating magnetic field. The rotor 63 is connected with a driving shaft 53 fixed to the bottom of the drum 5 by passing through the tub 4. As shown, the driving shaft 53 may be provided to be orthogonal to the bottom of the drawer 3.

A drum through hole 51 is provided on the outer circumference of the drum 5 to communicate the inside of the drum 5 with the inside of the tub 4.

The receiving portions are provided as the tub 4 and the drum 5 to allow the first treating apparatus L to perform a washing function. Therefore, in order that the first treating apparatus L may also perform a drying function of laundry, a hot-air supply unit supplying the hot air to the tub 2 is further provided inside the cabinet 2.

Since the hot-air supply unit provided in the first treating apparatus L may be provided in the same manner as the second hot-air supply unit described as above, its detailed description will be omitted.

In some implementations, if the first treating apparatus 1, is provided to perform only a drying function of laundry, the drum 5 is only provided as the receiving portion, and the hot-air supply unit provided in the first treating apparatus should be provided to supply the hot air to the drum 5.

The first treating apparatus L is connected with a water supply source located outside the laundry treating apparatus 100 through a water supply unit 7. The water supply unit 7 may include a water supply pipe 71 connecting the water supply source with the water supply unit 47, and a valve 73 opening or closing the water supply pipe 71.

The washing water stored in the tub 4 is discharged to the outside of the cabinet 2 through a drainage unit 8. The drainage unit 8 may include a drainage pipe 83 guiding the washing water inside the tub 4 to the outside of the cabinet 2, and a pump 81 (controlled by a controller) discharging the washing water inside the tub 4 to the drainage pipe 83.

Since the drum driver 6 is fixed to the tub 4 and the tub 4 is fixed to the drawer 3 through the tub support unit 48, the first treating apparatus L may deliver, to the drawer 3, vibration generated by the drum or the tub when the drum 5 is rotated by the drum driver 6.

If vibration of the drum 5 or the tub 4 is delivered to the drawer 3, noise or vibration may be generated by collision between the drawer 3 and the cabinet 2, and the drawer 3 may be ejected from the cabinet 2 during rotation of the drum driver 6.

To solve this problem, the laundry treating apparatus 100 may further include a detachable portion 9 that minimizes vibration of the drawer 3 inside the cabinet 2 as well as prevents the drawer 3 from being ejected from the cabinet 2.

The detachable portion 9 includes fastening units 911 and 913 provided to perform a reciprocating motion along any one of a height direction and a width direction of the drawer. The fastening units 911 and 913 detachably fix the drawer 3 to the cabinet 2. The detachable portion 9 also includes a feeding unit 95, or operating unit 95, operating the fastening units, and a driving unit 97 reciprocating the feeding unit 95 along the other one of the height direction and the width direction of the drawer.

FIGS. 3(*a*) and 3(*b*) illustrate that the fastening units 911 and 913 are provided to perform a reciprocating motion along a width direction X of the drawer 3 and the feeding unit 95 performs a reciprocating motion along a height direction Y of the drawer 3.

The fastening units may be provided as a first bar 911 detachable from one side of the cabinet 2 and a second bar 913 detachable from the other side of the cabinet 2.

The first bar 911 is connected to the feeding unit 95 through a first coupling unit 912, and a free end F1 of the first bar 911 is coupled to or detached from a first receiving body 931 provided in the cabinet 2 depending on the position of the feeding unit 95.

The second bar 913 is connected to the feeding unit 95 through a second coupling unit 914, and a free end F2 of the second bar 913 is coupled to or detached from a second receiving body 935 provided in the cabinet 2 depending on the position of the feeding unit 95.

To this end, the first receiving body 931 may be provided with a receiving groove 933 that may receive the free end of the first bar 911, and the second receiving body 935 may be provided with a receiving groove 937 that may receive the free end F2 of the second bar 913.

A reciprocating motion of the first bar 911 may be guided by a first bar guider 335 provided in the drawer 3, and a reciprocating motion of the second bar 913 may be guided by a second bar guider 337 provided in the drawer 3.

Figure 4A:
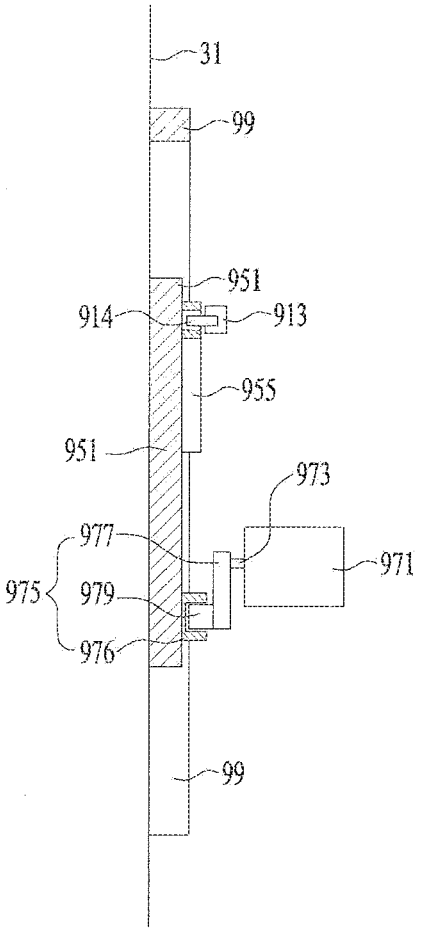
FIGS. 4(*a*) and 4(*b*) illustrate example detachable portions.
Figure 4B:
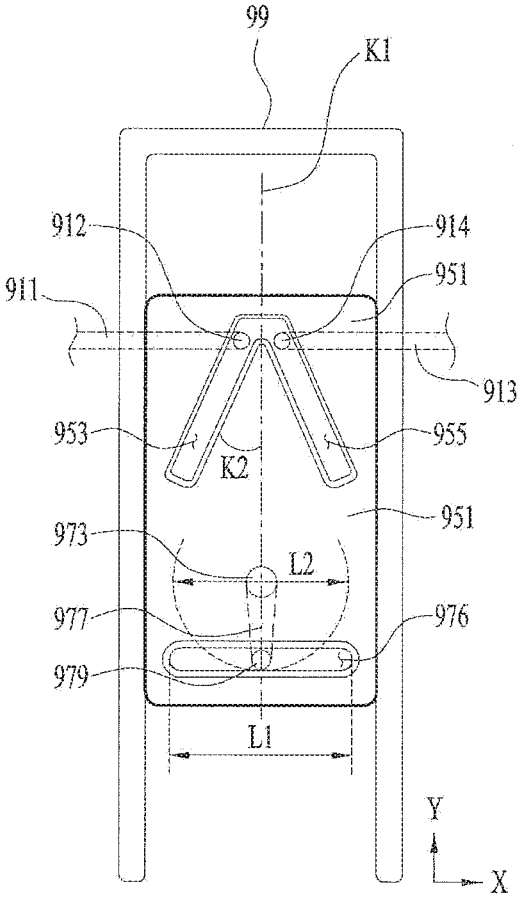

As shown in FIGS. 4(*a*) and 4(*b*), the feeding unit 95 may include a feeding body 951, or operating body 951, that may perform a reciprocating motion along the height direction Y of the drawer 3, a first slot 953 provided in the feeding body 951 and connected with the first bar 911, and a second slot 955 provided in the feeding body 951 and connected with the second bar 913.

The drawer 3 may be provided with a guider 99 providing a moving path of the feeding body 951. FIGS. 4(*a*) and 4(*b*) illustrate examples where the guider 99 is provided to support both sides of the feeding body 951.

The first slot 953 is a means (means for moving the first bar 911) pushing or pulling the first coupling unit 912 provided in the first bar, wherein the first coupling unit 912 is connected with the feeding body 951 by being inserted into the first slot 953.

The first slot 953 may be provided to be inclined at a predetermined angle with respect to a straight line (reference line K1) parallel with a moving direction of the feeding body 951 as well as to have a certain length along a motion direction (Y-axis direction, height direction of the feeding body) of the feeding body 951.

That is, the first slot 953 may be provided to be inclined at an angle K2 greater than 0° and smaller than 90° with respect to the reference K1. This is to move the first bar 911 by changing the position of the feeding body 951.

The second slot 955 is a means (means for moving the second bar 913) pushing or pulling the second coupling unit 914 provided the second bar, wherein the second coupling unit 914 is connected with the feeding body 951 by being inserted into the second slot 955.

The second slot 955 may also be provided to be inclined at a predetermined angle with respect to the reference line K1 as well as to have a predetermined length along a motion direction of the feeding body 951. In this case, the first slot 953 and the second slot 955 are provided to form axial symmetry based on the reference line K1.

A first direction is set to a moving direction of the feeding body 951 in which an interval between the first coupling unit 912 and the second coupling unit 914 is widened, and a second direction is set to a moving direction of the feeding body 951 in which an interval between the first coupling unit 912 and the second coupling unit 914 becomes narrow. In this case, the first slot 953 and the second slot 955 fix the free end F1 of the first bar and the free end F2 of the second bar to the cabinet 2 if the feeding body 951 moves to the first direction, and detach the free end of the first bar and the free end F2 of the second bar from the cabinet 2 if the feeding body 951 moves to the second direction.

FIG. 4 illustrates an example where that an upper end of the first slot 953 is connected with that of the second slot 955 and a lower end of the first slot 953 is detached from that of the second slot 955.

Unlike FIGS. 4(*a*) and 4(*b*), the first slot and the second slot may be provided in such a manner that the upper end of the first slot 953 is detached from that of the second slot 955 and the lower end of the first slot 953 is also detached from that of the second slot 955. In this case, a distance between the upper end of the first slot 953 and the upper end of the second slot 955 may be shorter than a distance between the lower end of the first slot 953 and the lower end of the second slot 955.

If the first coupling unit 912 and the second coupling unit 914 are respectively located on the upper ends (a point where the interval between the slots is minimum and a point where the distance between the first coupling unit and the second coupling unit is minimum) of the first slot 953 and the second slot 955, the free end F1 of the first bar and the free end F2 of the second bar may respectively be detached from the first receiving body 931 and the second receiving body 935.

In some implementations, if the first coupling unit 912 and the second coupling unit 914 are respectively located on the lower ends (a point where the interval between the slots is maximum and a point where the distance between the first coupling unit and the second coupling unit is maximum) of the first slot 953 and the second slot 955, the free end F1 of the first bar and the free end F2 of the second bar may respectively be coupled to the first receiving body 931 and the second receiving body 935.

Therefore, in FIGS. 4(*a*) and 4(*b*), a direction (direction that the upper end of each slot is located) that the distance between the first slot 953 and the second slot 955 becomes short becomes the first direction, and a direction (direction that the lower end of each slot is located) that the distance between the first slot 953 and the second slot 955 becomes increased becomes the second direction.

Unlike FIGS. 4(*a*) and 4(*b*), the distance between the upper end of the first slot 953 and the upper end of the second slot 955 may be longer than the distance between the lower end of the first slot 953 and the lower end of the second slot 955.

Even in this case, if the feeding body 951 moves to the first direction that the interval between the respective bars 911 and 913 is widened, the free end F1 of the first bar and the free end F2 of the second bar may be fixed to the cabinet 2. If the feeding body 951 moves to the second direction that the interval between the respective bars 911 and 913 becomes narrow, the free end F1 of the first bar and the free end F2 of the second bar may be detached from the cabinet 2.

That is, if the first coupling unit 912 and the second coupling unit 914 are respectively located on the upper ends of the first slot 953 and the second slot 955, the free end F1 of the first bar and the free end F2 of the second bar may respectively be coupled to the first receiving body 931 and the second receiving body 935. If the first coupling unit 912 and the second coupling unit 914 are respectively located on the lower ends of the first slot 953 and the second slot 955, the free end F1 of the first bar and the free end F2 of the second bar may respectively be detached from the first receiving body 931 and the second receiving body 935.

The aforementioned feeding unit 95 may perform a reciprocating motion along the height direction Y of the drawer through the driving unit 97 provided in the drawer 3. The driving unit 97 may include a motor 971 fixed to the drawer 3, and a transform unit 975 transforming a rotation power of the motor 971 to a reciprocating power of the feeding body 951.

The transform unit 975 may include a body slot 976 provided along the width direction X of the feeding body 951, an arm 977 coupled to a rotational axis 973 of the motor 971, and a slot connecting unit 979 connecting the arm 977 with the body slot 976.

The arm 977 is rotated by the rotational axis 973 of the motor, and the slot connecting unit 979 is extended from the arm 977, whereby the slot connecting unit 979 may be rotated with a circular tracking having a certain diameter L2 during operation of the motor 971.

In some implementations, the body slot 976 is provided along the direction X vertical to the motion direction Y of the feeding body 951, and has a length L1 the same as or longer than the diameter L2 of the circular tracking formed by the slot connecting unit 979.

Therefore, a rotation motion of the motor rotational axis 973 is transformed to a straight-line reciprocating motion of the feeding body 951 by the transform unit 975, and the feeding body 951 performs a reciprocating motion along the height direction Y of the drawer 3 under the guide of the guider 99.

Hereinafter, the operation process of the detachable portion 9 having the aforementioned structure will be described with reference to FIGS. 3(*a*) to 5(*b*).

If the body slot 976 is located at a position lower than the rotational axis 973 of the motor 971 in accordance with the operation of the motor 971 (the states of FIGS. 4(*a*) and 4(*b*) that the first coupling unit 912 is located on the upper end of the first slot 953 and the second coupling unit 914 is located on the upper end of the second slot 955), each of the first bar 911 and the second bar 913 moves toward the feeding body 951. Therefore, the free end F1 of the first bar is detached from the first receiving body 931, and the free end F2 of the second bar is detached from the second receiving body 935 (see FIGS. 3(*a*) and 3(*b*)).

If the free end F1 of the first bar and the free end F2 of the second bar are respectively detached from the respective receiving bodies 931 and 935, since coupling between the drawer 3 and the cabinet 2 is released, the user may eject or insert the drawer 3 from or into the cabinet 2.

In some implementations, if the rotational axis 973 of the motor is rotated by a controller, the feeding body 951 moves toward the upper end of the drawer 3 along the guider 99. If the body slot 976 moves to the position higher than the rotational axis 973 in accordance with the ascending movement of the feeding body 951, the fastening units 911 and 913 becomes a state of FIG. 5(*a*).

That is, if the body slot 976 moves to the position higher than the rotational axis 973, each of the free end F1 of the first bar and the free end F2 of the second bar moves toward a direction far away from the feeding body 951 (the first bar and the second bar move to be far away from each other).

If the free ends F1 and F2 of the respective bars move toward the direction far away from the feeding body 951, the free end F1 of the first bar is coupled to the first receiving body 931, and the free end F2 of the second bar is coupled to the second receiving body 933, whereby the drawer 3 is fixed to the cabinet 2.

As shown in FIG. 2, the tub support unit 48 provided in the first treating apparatus L connects the outer circumference of the tub 4 with the drawer 3. Therefore, the tub 4 may be vibrated inside the drawer 3 during rotation of the drum 5, and if vibration of the tub 4 is delivered to the drawer 3, the drawer 3 may be ejected from the cabinet 3. However, since the detachable portion 9 fixing the drawer to the cabinet is provided, the aforementioned problem is solved.

However, in the laundry treating apparatus 100 having the aforementioned structure, if the driving unit 97 is out of order in a state that the drawer 3 is fixed to the cabinet 2, a problem occurs in that it is difficult to eject the drawer 3 from the cabinet 2.

To solve this problem, the laundry treating apparatus 100 may further include an unlocking unit 98 for allowing the drawer 3 fixed to the cabinet 2 to be ejected from the cabinet 2.

Figure 6:
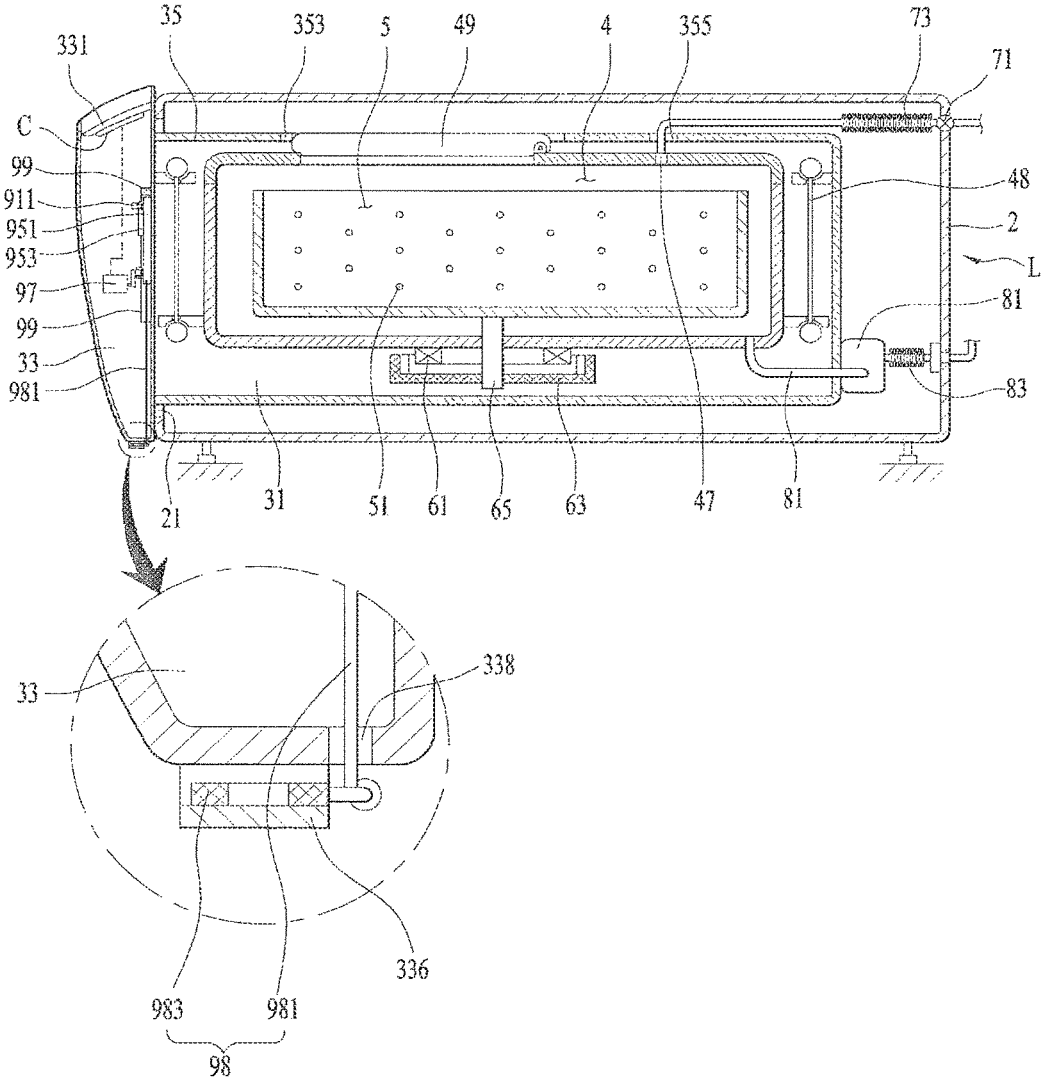
FIGS. 6 and 7 illustrate example unlocking units.

The unlocking unit 98 is operated independently from the driving unit 97, and may be implemented in various structures for enabling the aforementioned function. FIGS. 6(*a*) and 6(*b*) illustrate examples of an unlocking unit 98 that enables one-way movement of the feeding body 951. That is, the unlocking unit 98 of FIGS. 6(*a*) and 6(*b*) may include a handle 983 detachable from the drawer 3 and a wire 981 connecting the feeding body 951 with the handle 983.

The handle 983 may be fixed to the outer circumference of the drawer 3 through a handle support unit 336 provided in the drawer 3. The handle support unit 336 may be provided on the bottom of the drawer panel 33. In this case, a panel through hole 338, through which the wire 981 passes, should be provided on the bottom of the drawer panel 33.

Figure 7:
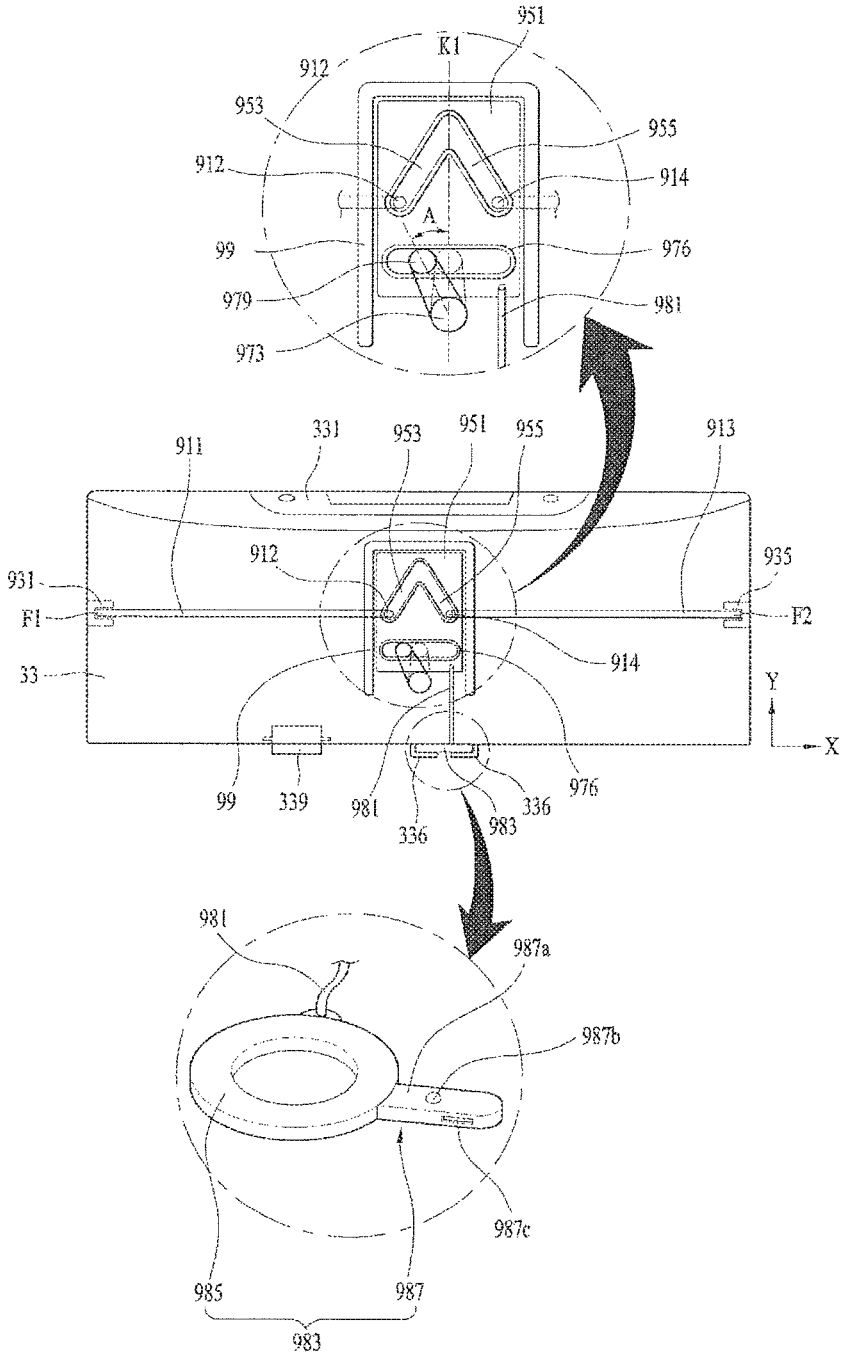

As shown in FIG. 7, the handle 983 may include a handle body 985 inserted into the handle support unit 336, and an ejecting unit 987 ejecting the handle body 985 from the handle support unit 336, wherein one end of the wire 981 is fixed to the handle body 985.

The ejecting unit 987 may be implemented in various manners as far as the handle body 985 may be ejected from the handle support unit 336. In FIG. 7, the ejecting unit 987 may include a plate 987*a* provided to be extended from the handle body 985, a protrusion 987*b* protruded from the plate 987*a*, and a pressurizing request unit 987*c* located between a free end of the plate 987*a* and the protrusion 987*b*.

FIG. 7 illustrates that the protrusion 987*b* is in contact with the bottom of the drawer panel 33. In this case, the protrusion 987*b* may be protruded at a length, which may be in contact with the bottom of the drawer panel if the handle body 985 is inserted into the handle support unit 336.

In some implementations, if the protrusion 987*b* is provided in contact with the handle support unit 336, the protrusion 987*b* should be protruded at a length that may be in contact with the handle support unit 336 if the handle body 985 is inserted into the handle support unit 336.

Once the pressurizing request unit 987*c* is pushed, since the handle body 985 is rotated around the protrusion 987*b*, the user may eject the handle body 985 from the handle support unit 336.

If the free end F1 of the first bar and the free end F2 of the second bar are respectively coupled to the first receiving body 931 and the second receiving body 935, the drawer 3 is fixed to the cabinet 2 (the state that the drawer is not ejected from the cabinet).

In this state, if the user pulls the wire 981 toward the second direction by using the handle 983, the feeding body 951 will move toward the bottom of the drawer panel 33.

As described above, the second direction means a moving direction of the feeding body 951, which makes the interval between the first coupling unit 912 and the second coupling unit 914 narrow. In FIG. 7, the direction (the direction that the wheel 339 is located) that the bottom of the drawer panel 33 is located becomes the second direction.

If the feeding body 951 moves toward the bottom of the drawer panel 33, since the free end F1 of the first bar and the free end F2 of the second bar are respectively detached from the first receiving body 931 and the second receiving body 935, the aforementioned unlocking unit 98 may release the state that the drawer 3 is fixed to the cabinet 2, regardless of the operation of the driving unit 97.

Since the feeding body 951 is connected to the handle body 985 through the wire 981, the unlocking unit 98 moves the feeding body 951 in a second direction only. That is, the unlocking unit 98 fails to move the feeding body 951 in a first direction.

In some implementations, if the drawer 3 is fixed to the cabinet 2 by the fastening units 911 and 913, an angle A between the straight line K1 (reference line parallel with the moving direction of the feeding body 951 and the arm 977 should be greater than 0° and smaller than 180°.

With an angle outside of the range between 0° and 180°, the user may have difficulty in moving the feeding body 951 in a second direction or cannot move the feeding body 951 in a second direction due to the slot connecting unit 979 provided in the arm 977. In this case, even though the user pulls the handle body 985, if the angle between the reference line K1 and the arm 977 is 0° or 180°, the drawer 3 may remain in a state where the drawer 3 is fixed to the cabinet 2.

Therefore, the controller C (see FIGS. 6(*a*) and 6(*b*)) controls a rotational angle of the rotational axis 973 provided in the motor 971 so that the angle between the reference line K1 and the arm 977 may not be 0° or 180° when the feeding body 951 completely moves to the first direction.

Unlike FIGS. 3 to 7, the fastening units 911 and 913 may be provided to perform a reciprocating motion along the height direction Y of the drawer 3, and the feeding unit 95 may be provided to perform a reciprocating motion along the width direction X of the drawer 3.

That is, the first bar 911 may be provided to perform a reciprocating motion along the height direction of the drawer 3 and connects the upper surface of the drawer 3 with the upper surface of the cabinet 2. The second bar 913 may be provided to perform a reciprocating motion along the height direction of the drawer 3 and connects the lower surface of the drawer 3 with the lower surface of the cabinet 2. The feeding body 951 may be provided to perform a reciprocating motion along the width direction of the drawer 3.

Even in this case, the first slot 953 and the second slot 955 may be provided in such a manner that the free end F1 of the first bar and the free end F2 of the second bar may be fixed to the cabinet 2 if the feeding body 951 moves to the first direction that the interval between the respective bars 911 and 913 is widened. The free end F1 of the first bar and the free end F2 of the second bar may be detached from the cabinet 2 if the feeding body 951 moves to the second direction that the interval between the respective bars 911 and 913 becomes narrow.

What is claimed is:

1. A laundry treating apparatus comprising:

a drawer;

a cabinet that is configured to receive the drawer;

a drum that is configured to rotate, that is located inside the drawer, and that is configured to receive laundry;

fastening units that are configured to couple the drawer to the cabinet by reciprocating in one of a horizontal direction or a vertical direction of the drawer;

an operating unit that is configured to operate the fastening units and that includes an operating body that is configured to reciprocate along the vertical direction of the drawer;

a driving unit that is configured to reciprocate the operating unit along another one of the horizontal direction or the vertical direction; and an unlocking unit that is configured to decouple the fastening units from the cabinet by enabling one-way movement of the operating unit and that includes:

a handle that is located on the drawer and that is configured to detach from the drawer; and a wire that is configured to connect the operating body with the handle and that is configured to move the operating body in a particular direction only.

2. The laundry treating apparatus according to claim 1, wherein the fastening units include:

a first bar reciprocating along the horizontal direction of the drawer by means of the operating unit, that includes a first coupling unit that is connected to the operating unit, and that includes a first bar free end that is configured to engage the cabinet; and a second bar reciprocating along the horizontal direction of the drawer by means of the operating unit, that includes a second coupling unit that is connected to the operating unit, and that includes a second bar free end that is configured to engage the cabinet.

3. The laundry treating apparatus according to claim 2, wherein:

the operating body defines a first slot that is configured to receive the first coupling unit, that is configured to connect the first bar free end to the cabinet based on the operating body moving in a first direction, and that is configured to detach the first bar free end from the cabinet based on the operating body moving in the particular direction, and the operating body defines a second slot that is configured to receive the second coupling unit, that is configured to connect the second bar free end to the cabinet based on the operating body moving in the first direction, and that is configured to detach the second bar free end from the cabinet based on the operating body moving in the particular direction.

4. The laundry treating apparatus according to claim 3, wherein:

the first slot and the second slot are symmetrical about a reference line that is parallel with a direction that the operating body is configured to move, and the first slot and the second slot each define an angle with respect to the reference line that is greater than zero and less than ninety degrees.

5. The laundry treating apparatus according to claim 4, wherein:

a distance between the first coupling unit and the second coupling unit increases based on the operating body moving in the first direction, and the distance between the first coupling unit and the second coupling unit decreases based on the operating body moving in the particular direction.

6. The laundry treating apparatus according to claim 1, wherein the drawer further includes a handle support unit that defines a space that is configured to receive the handle.

7. The laundry treating apparatus according to claim 6, wherein the handle includes:

a handle body that is connected to an end of the wire, wherein the handle support unit is configured to receive the handle body; and an ejecting unit that is configured to eject the handle body from the handle support unit.

8. The laundry treating apparatus according to claim 7, wherein the ejecting unit includes:

a plate that extends from the handle body, a protrusion that protrudes from the plate, and a pressurizing request unit that is located between the protrusion and an end of the plate that is opposite the plate.

9. The laundry treating apparatus according to claim 7, wherein the handle body is round and defines a hole in a middle of the handle body.

10. The laundry treating apparatus according to claim 8, wherein the handle body is configured to rotate about the protrusion and eject from the handle support unit based on pressure being applied to the pressurizing request unit.

11. The laundry treating apparatus according to claim 6, wherein:

the handle support unit is located on a bottom of the drawer, and the drawer defines a panel through hole through which the wire passes.

12. The laundry treating apparatus according to claim 11, wherein:

the drawer further includes a wheel that is located on the bottom of the drawer, that is configured to support the drawer during movement of the drawer in and out of the cabinet, and the handle support unit is spaced apart from a ground by the wheel.

13. The laundry treating apparatus according to claim 12, wherein the wheel is located at a front of the drawer and is located closer to one side of the drawer than to another side of the drawer.

* * * * *